US009933138B2

(12) United States Patent
Kickel et al.

(10) Patent No.: US 9,933,138 B2
(45) Date of Patent: Apr. 3, 2018

(54) HOLDER FOR MULTIPLE INTERCHANGEABLE LIGHT ACCESSORIES

(71) Applicant: GE Lighting Solutions, LLC, East Cleveland, OH (US)

(72) Inventors: William George Kickel, North Royalton, OH (US); Mark Edward Kaminski, Beachwood, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 22 days.

(21) Appl. No.: 15/163,751

(22) Filed: May 25, 2016

(65) Prior Publication Data

US 2017/0343192 A1 Nov. 30, 2017

(51) Int. Cl.

| | |
|---|---|
| ***F21V 17/00*** | (2006.01) |
| ***F21V 17/16*** | (2006.01) |
| *F21Y 115/10* | (2016.01) |

(52) U.S. Cl.

CPC ..... *F21V 17/002* (2013.01); *F21V 17/164* (2013.01); *F21V 17/166* (2013.01); *F21Y 2115/10* (2016.08)

(58) Field of Classification Search

None

See application file for complete search history.

(56) References Cited

U.S. PATENT DOCUMENTS 3,117,732 A * 1/1964 Lee ..... F21V 21/02 362/322
3,130,949 A * 4/1964 Wolff ..... E04B 9/006 248/343
6,896,394 B2 * 5/2005 Houle ..... F21V 21/04 362/147
6,942,368 B1 9/2005 Kane et al.
7,488,092 B2 2/2009 Mier-Langner et al.
(Continued)

FOREIGN PATENT DOCUMENTS

DE 202007004216 U1 5/2007

OTHER PUBLICATIONS

Juno: Juno Track Lighting TM538BL Accessory Holder for Pro-Gimbal Ring Lampholders Black Color. Retreived from the Internet http://www.electricbargainstores.com/product-p/juno-tm538bl.htm on May 24, 2016.

(Continued)

*Primary Examiner* — Ashok Patel
(74) *Attorney, Agent, or Firm* — Peter T. DiMauro; GE Global Patent Operation

(57) ABSTRACT

The specification and drawings present a new light accessory holder, comprising only one part, for placing and interchanging multiple optical accessories in a lighting fixture near/in front of a light sources such as LEDs. The holder can use multiple notched springs (e.g., three) to push accessories forward and holds them in a desired position. The may be removed from the lighting fixture, so the user can load into the holder whatever accessories are needed, and then return the re-loaded holder into the light fixture. Accessories may include but are not limited to diffusers, glass components (optical filers), Hexcel Louvers, snoots, or other objects that are intended to alter the color or shape of a light source.

19 Claims, 6 Drawing Sheets

(56) References Cited

U.S. PATENT DOCUMENTS

| | | | | |
|---|---|---|---|---|
| 7,517,113 | B2 | 4/2009 | Bruckner | |
| 7,563,016 | B1 | 7/2009 | Mier-Langner et al. | |
| 2008/0158893 | A1* | 7/2008 | Gauthier ..... | F21S 8/02<br>362/368 |
| 2013/0107570 | A1 | 5/2013 | Liao et al. | |

OTHER PUBLICATIONS

European Search Report and Opinion issued in connection with corresponding EP Application No. 17171186.4 dated Jul. 31, 2017.

* cited by examiner

HOLDER FOR MULTIPLE INTERCHANGEABLE LIGHT ACCESSORIES

TECHNICAL FIELD

The invention generally relates to lighting systems. More particularly but not exclusively, this invention relates to a light accessory holder for placing and interchanging multiple optical accessories in a lighting fixture.

BACKGROUND OF THE INVENTION

In track lighting and other light fixture envelopes, it is beneficial to use diffusers, glass, or other items to change a beam pattern or a light color. These items, referred to as accessories, are required by some customers so they can have different light outputs from the same light fixture. In retail applications for example, customers will want specific accessory combinations for different displays within the store. Also in environments in which the lighting requirements change from time to time, for example, in theaters, galleries, museums, etc., it may be necessary to replace or exchange some or all of the accessory elements installed in a particular fixture. This creates a necessity to provide removal and/or exchange of accessory elements to meet the customers need. Mechanically holding these accessories in place becomes a challenge, as it is difficult to determine the number and type of accessories that will be wanted. Multiple mechanical pieces, or multiple holders may be necessary to solve this challenge using conventional means.

SUMMARY OF THE INVENTION

According to an aspect of the invention, a holder (e.g., removable, interchangeable and made by injection molding from a plastic material), in a lighting fixture for placing interchangeable optical accessories near a light source (e.g., one or more LEDs), comprising: one part, having a closed perimeter structure with a side wall crossing a perimeter (such as a circle, rectangle, ellipse, etc.) and perpendicular to a perimeter plane, the side wall being limited by bottom and top planes and having top and bottom openings (e.g., the bottom and top planes being parallel), the one part is configured to accommodate placing one or more optical accessories inside the side wall, where each of the one or more optical accessories matches internal dimensions of the side wall for smooth inserting to and for forming a close fit with internal surfaces of the side wall, the one part further comprises: multiple springs, spaced along the perimeter and vertically cut in the side wall from the top plane toward the bottom plane until a predefined distance from the bottom plane, where each spring originated near the bottom plane is tilted inward from the perimeter by a predefined extent, so that when each accessory of the one or more optical accessories is inserted into the one part through the top opening, at least one of the multiple springs is manually bent outward of the perimeter to allow the each accessory to slide down inside the side wall, and then, after the at least one spring being brought back to an original position by a spring effect, the multiple springs tightly hold the each optical accessory in place; and multiple ledges, spaced along the perimeter on the bottom plane and attached to the side wall, configured to keep optical accessories from falling down. Further, the holder with a circular perimeter can comprise a ring holder.

According further to the aspect of the invention, each of the multiple springs may comprise notches, parallel to the bottom plane, along the perimeter, at different distances from the bottom plane in order to push forward and hold the each inserted accessory in a desired position. Further the multiple springs can comprise three strings 120° apart.

According further to the aspect of the invention, the holder, when placed in a lighting fixture, may be held in place by a spring force generating by bended legs of the holder spaced along the perimeter and attached to a bottom surface of the side wall. Further, the bended legs may be 120° apart.

Still further according to the aspect of the invention, tan inside surface of the side wall may comprise at least two vertical grooves of different sizes for allowing only one direction of installation of corresponding optical accessories when inserted into the holder by matching with corresponding features complimenting the at least two vertical grooves on the corresponding optical accessories.

According further to the aspect of the invention, one of the one or more optical accessories may comprise a diffuser, an optical filter, and a Hexcel Louver.

BRIEF DESCRIPTION OF THE DRAWINGS

These and other features and aspects of the present disclosure will become better understood when the following detailed description is read, with reference to the accompanying drawings, in which like characters represent like parts throughout the drawings, wherein.

DETAILED DESCRIPTION

A new light accessory holder, comprising only one part, for placing and interchanging multiple optical accessories in a lighting fixture near/in front of a light sources is presented. The holder can use multiple notched springs (e.g., three) to push accessories forward and holds them in place. The holder may be removable from the lighting fixture, so the user can load into the holder whatever accessories are needed, and then return the re-loaded holder into the light fixture. According to an embodiment described herein, multiple accessories form one to N (N is a finite number, e.g., N=3) can be placed in the holder near/in front of a light source. Accessories include but are not limited to diffusers, glass components (optical filers), Hexcel Louvers, snoots, or other objects that are intended to alter the color or shape of a light source.

According to an embodiment of the invention, a removable/interchangeable holder (in a lighting fixture) can comprise only one part, for placing interchangeable optical accessories near a light source (e.g., light emitting diode, LED). The one part holder may have a closed perimeter structure with a side wall crossing a perimeter/perimeter line (e.g., a circle, a rectangle, an ellipse or the like) and perpendicular to a perimeter plane comprising the perimeter/perimeter line. The side wall may be limited by bottom and top surfaces/planes (e.g., these surface/planes may be parallel to each other and to the perimeter plane) and having corresponding top and bottom openings. The one part may be configured to accommodate placing of one or more optical accessories inside of the side wall, where each of the one or more optical accessories matches internal dimensions of the side wall for smooth inserting to and for forming a close fit with the internal surfaces of the side wall.

The one part can further comprise multiple springs, spaced along the perimeter (e.g., three springs 120° apart) and vertically cut in the side wall from the top surface/plane toward the bottom surface/plane until a predefined distance from the bottom surface/plane, where each spring originated near the bottom plane is tilted inward from the perimeter (toward the top plane) by a predefined extent (angle/distance), so that when each accessory of the one or more optical accessories is inserted into the one part through the top opening, at least one of the multiple springs is manually bent outward of the perimeter to allow the each accessory to slide down inside the side wall, and then the multiple springs, after being back to original positions by a spring effect, tightly hold the each optical accessory in place. The one part can further comprise multiple ledges, spaced along the perimeter and attached to a bottom surface of the side wall for keeping optical accessories from falling down.

Figure 3:
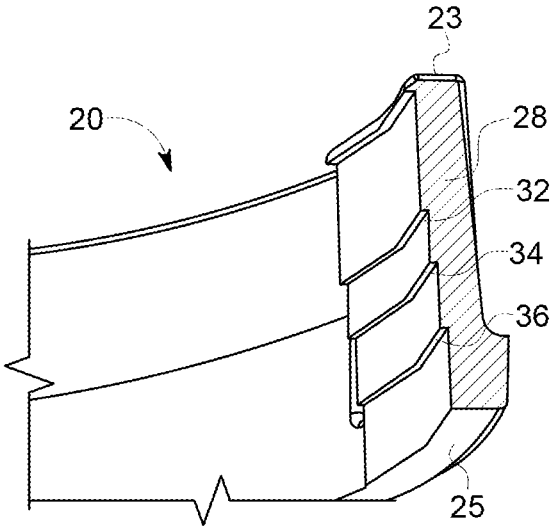
FIG. 3 is an exemplary view of a spring with notches configured to push forward and hold multiple optical accessories, according to an embodiment of the invention.

According to a further embodiment, each of the multiple springs may comprise notches (e.g., as shown in FIG. 3), parallel to the bottom plane (or the top plane), along the perimeter, at different distances (e.g., equally spaced) from the bottom plane in order to push forward and hold each inserted accessory sturdy in a desired position.

Figure 1:
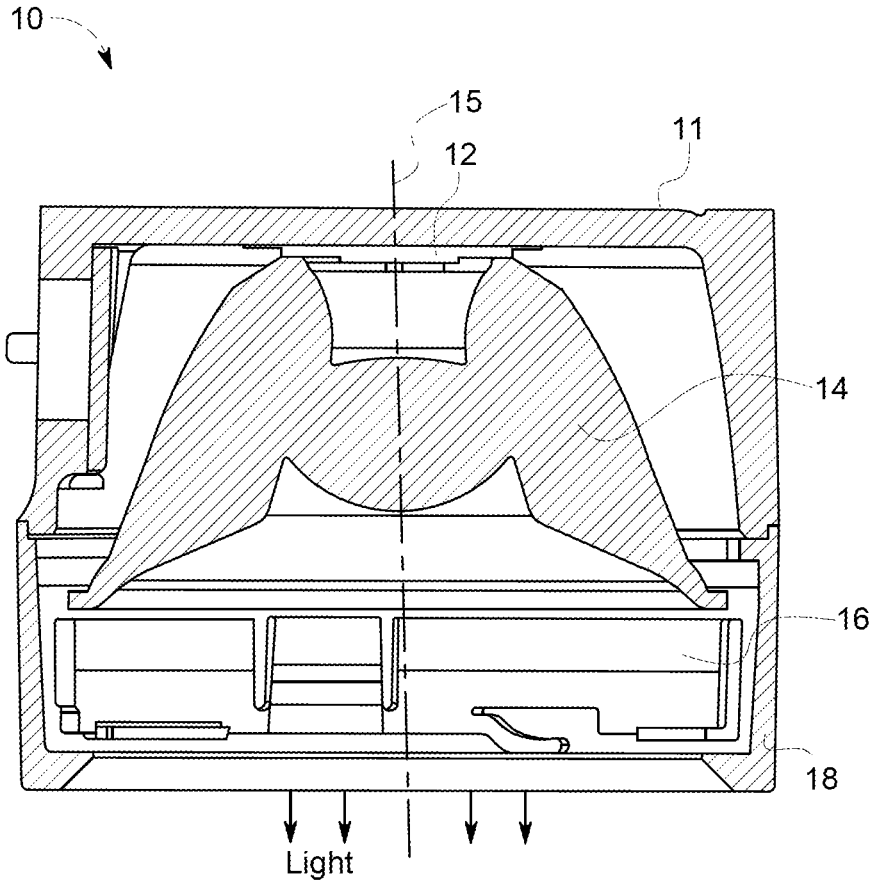
FIG. 1 is a sectional view of an exemplary light fixture, according to an embodiment of the invention.

According to another embodiment, the holder, when placed in a lighting fixture (as shown in FIG. 1), can be held in place by a spring force generated by bended legs of the holder spaced along the perimeter and attached to a bottom surface of the side wall. For example, the bended legs may comprise three bended legs 120° apart. Moreover, the holder (comprising one part) can be removed from and interchanged in the lighting fixture without any additional lock feature, for loading different optical accessories.

According to further embodiments, surfaces of the one or more optical accessories, when placed in the holder, can be perpendicular to the side wall. Also, the holder and the inserted one or more optical accessories can have a common (central) optical axis parallel to the side wall.

Furthermore, an outside dimension of the one or more optical accessories and an inside dimension of the side wall may be matched, where the outside dimension of the one or more optical accessories is smaller than the inside dimensions of the side wall by a predefined small value for providing smooth inserting of accessories to and forming a close fit of accessories with the side wall.

According to a further embodiment, an inside surface of the side wall can comprise at least two vertical grooves of different sizes for allowing only one direction of installation of corresponding optical accessories (e.g., a diffuser) when inserted into the holder, by matching with corresponding features complimenting the at least two vertical grooves on the corresponding optical accessories.

It is further noted that the holder can be made of a plastic material using, for example, injection molding. The plastic material can be a type of polycarbonate (PC) or its variations, a type of ABS (acrylonitrile-butadiene-styrene copolymer), a material like polypropylene and the like. The injection molding seems to be very feasible manufacturing method to create this holder described herein, but possibly other methods, like 3D printing technology, can be used as well.

FIGS. 1-8 illustrate construction, performance and application of a circular (one part) holder, as described in further detail below. Similar or identical elements shown in different figures are designated using the same reference numbers.

FIG. 1 is a sectional view of an exemplary light (track) fixture 10, according to an embodiment of the invention. The fixture 10 comprises a light fixture housing 11, a LED source 12 (e.g., one or more LEDs), optics 14 (e.g., one or more lenses), an accessory ring holder 16 (which is a one part holder implemented as a ring), and a cap 18. The light is emerged from a bottom of the fixture 10 after passing through the optical accessories placed in the ring holder 16. An optical axis of the emerging light can correspond to a physical axis 15 of the LEDs source 12, optics 14 and the ring holder 16. When the cap 18 is removed, the ring holder 16 can be removed and exchanged with different optical accessories, as described herein.

Figure 2:
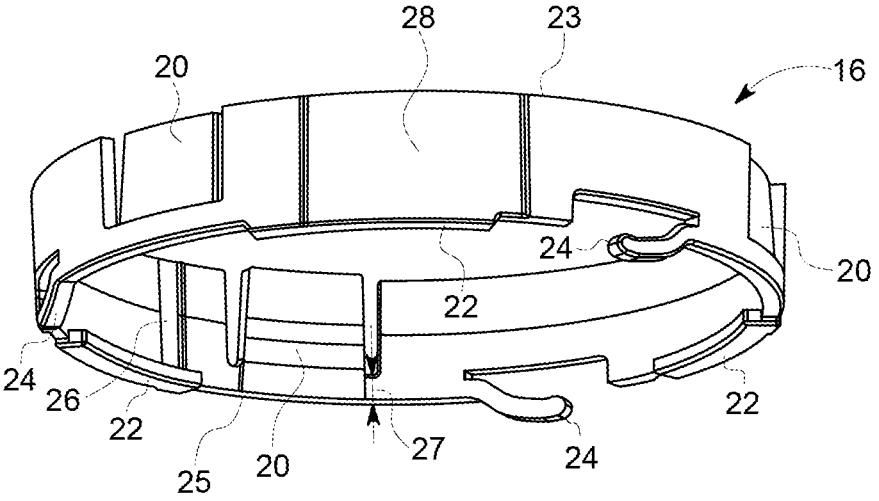
FIG. 2 is a three-dimensional view of a ring holder implemented as one part for holding interchangeable optical accessories, according to an embodiment of the invention.

FIG. 2 is a three-dimensional view of the ring (one part) holder 16 for holding interchangeable optical accessories (not shown in FIG. 2), according to an embodiment of the invention. The holder 16 has a round perimeter which can be represented by a circle perimeter line along a side wall 28 in a perimeter plane. The perimeter plane can be defined as any cross sectional plane perpendicular to a central axis (e.g., shown as the axis 15 in FIG. 1) of the ring holder 16 which crosses the side wall 28 of the ring holder 16. Top and bottom surfaces 23 and 25 define corresponding top and bottom planes (parallel to each other and to the perimeter plane) are perpendicular to the side wall 28. The side wall 28 is limited by the bottom and top planes/surfaces (which are parallel to each other and to the perimeter plane) and having the top opening for inserting optical accessories, and the bottom opening for the light to go through. The one part is configured to accommodate placing one or more optical accessories inside of the side wall 28, where each of the one or more optical accessories matches internal dimensions of the side wall 28 for smooth inserting of accessories to and forming a close fit of accessories with the side wall, as discussed herein.

Moreover, the ring holder 16 further comprises three springs 20, spaced along the perimeter 120° apart and vertically cut in the side wall 28 from the top surface (plane) 23 toward the bottom surface (plane) 25 until a predefined distance 27 from the bottom 25, where each spring 20 originated near the bottom plane 25 is tilted inward from the perimeter (toward the top plane 25) by a predefined extent (distance/angle). Then, when an optical accessory is inserted into the ring holder 16 through the top opening, at least one (may be more than one) of the springs 20 is manually bent outward of the perimeter to allow this accessory to slide down inside the side wall. After the manually bent at least one spring 20 being brought back to the original position by a spring effect, the multiple springs 20 can tightly hold the optical accessory in place.

The ring holder 16 further comprises three ledges 22, spaced along the perimeter 120° apart and attached to a bottom surface 25 of the side wall 28. The three ledges 22 are configured to keep optical accessories from falling down from the ring holder 16.

According to another embodiment, the ring holder 16, when placed in a lighting fixture 10 (e.g., as shown in FIG. 1), can be held in place by a spring force generated by bended legs 24 spaced along the perimeter and attached to the bottom surface 25 of the side wall 28. For example, the bended legs 24 may comprise three bended legs 120° apart. Moreover, the ring holder 16 (comprising the one part) can be removed from and interchanged in the lighting fixture without any additional lock feature (or the like), for loading different optical accessories, as stated herein.

Moreover, an outside dimension of the one or more optical accessories and an inside dimension of the side wall 28 may have a similar circular shape and dimensions for providing smooth inserting of the optical accessories to and forming a close fit of accessories with the side wall 28.

Figure 5A:
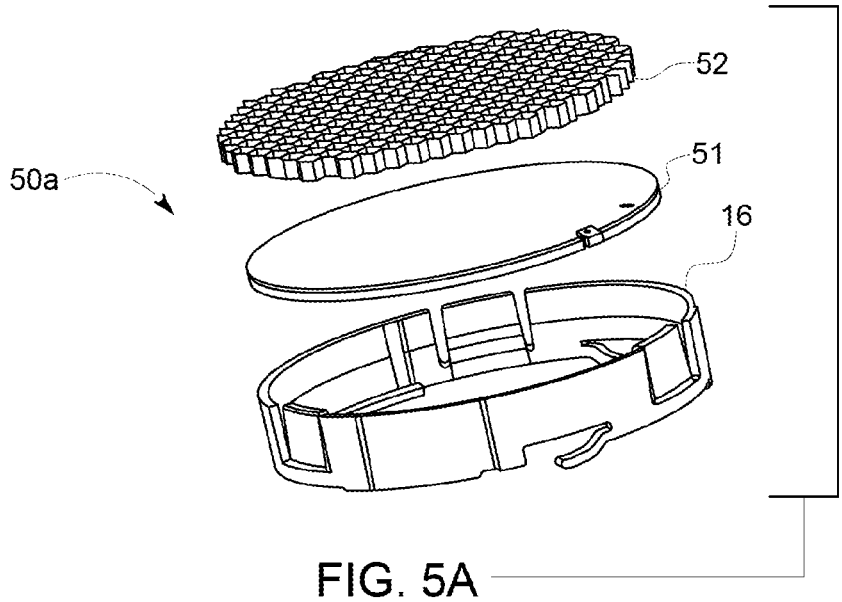
FIGS. 5A, 5B, 5C and 5D are exemplary views for illustration of assembling the ring holder with two optical accessories, according to an embodiment of the invention described herein.
Figure 5B:
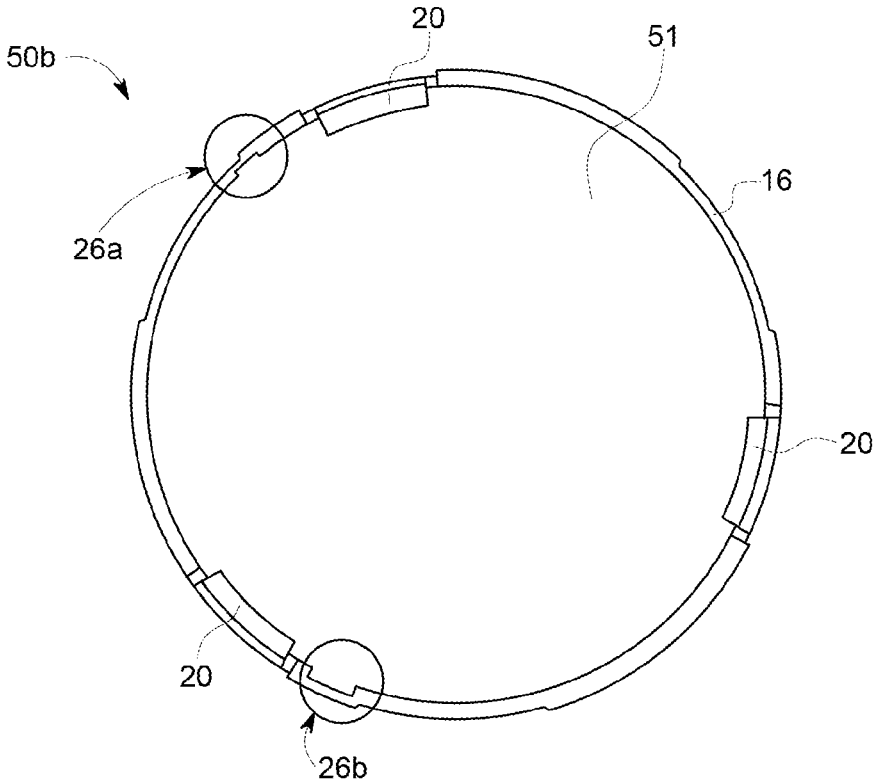

According to a further embodiment, the inside surface of the side wall 28 can comprise at least two vertical grooves of different sizes 26 (only one groove is visible in FIG. 2) for allowing only one direction of installation of corresponding optical accessories (e.g., a diffuser) when inserted into the ring holder 16, by matching with corresponding features complimenting the at least two vertical grooves on the corresponding optical accessory (see an example in FIG. 5B).

It is further noted that the ring holder 16 can be made of a plastic material using injection molding.

Figure 4A:
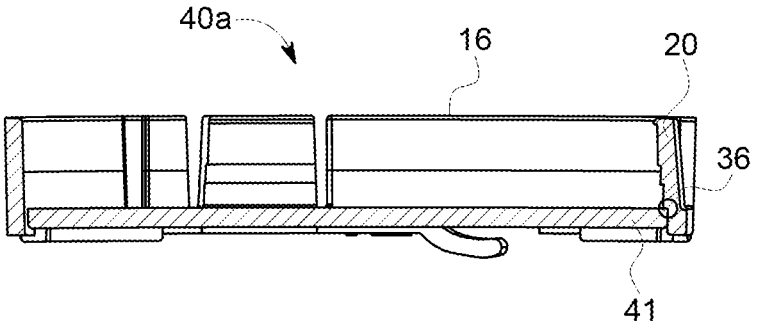
FIGS. 4A and 4B are exemplary cross-sectional views demonstrating how the spring notches are used for holding the optical accessories in the ring holder, according to an embodiment of the invention.
Figure 4B:
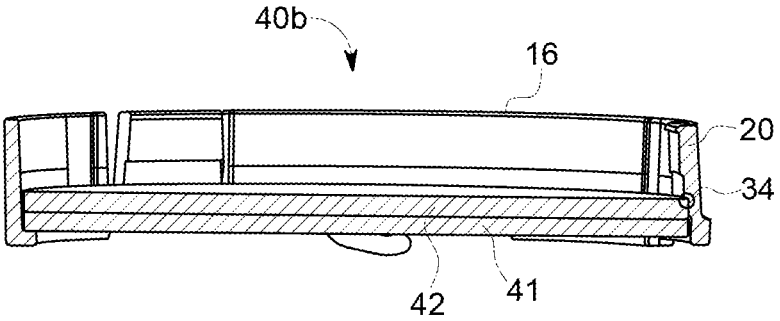

FIG. 3 shows an exemplary view of a spring 20 comprising notches 32, 34 and 36, e.g., parallel to the bottom surface 25, along the internal surface of the side wall 28, at predefined distances from the bottom 25 (e.g., equally spaced) in order to push forward and hold each inserted optical accessory sturdy in place. This also helps to keep accessories from becoming loose during shipping and handling. FIGS. 4A and 4B further demonstrate how the spring notches may be used for holding the optical accessories, according to an embodiment of the invention.

FIG. 4A shows an exemplary cross-sectional view 40*a* of the ring holder 16 assembled with an optical accessory 41, which can be an optical filter (for selecting specific wavelength of the light output), a diffuser (to alter light beam angles), or the like. The spring 20 with the notch/groove 36 (see FIG. 3) is holding the optical accessory 41 in place.

FIG. 4B shows an exemplary cross-sectional view 40*b* of the ring holder 16, when a second optical accessory 42 is inserted on the top of the optical accessory 41. In this case, as the spring 20 is pushed out, a next groove 34 see FIG. 3) becomes the dominant component in holding both components 41 and 42 in place as shown in FIG. 4B.

FIGS. 5A, 5B, 5C and 5D show exemplary views of assembling the ring holder 16 with two optical accessories 51 and 52, according to an embodiment of the invention described herein. FIG. 5A is a view 50*a* of the ring holder 16 to be assembled with a diffuser 51 and a Hexcel Louver 52. The Hexcel Louver 52 can be made of a metal or plastic material and have a honeycomb shape, for eliminating light glare in the output light of the light fixture (e.g., shown in FIG. 1).

FIG. 5B is a top view 50*b* of the ring holder 16 assembled with the diffuser 51. In this example the diffuser design requires diffuser's one side facing the light source (e.g., LED), thus there is only one way it can be placed in the ring holder 16. That is achieved using complimentary and matching features (groves-like) 26*a* and 26*b* of different sizes as discussed above. Also, it is clearly shown how the springs 20 hold the diffuser 51 in place.

Figure 5C:
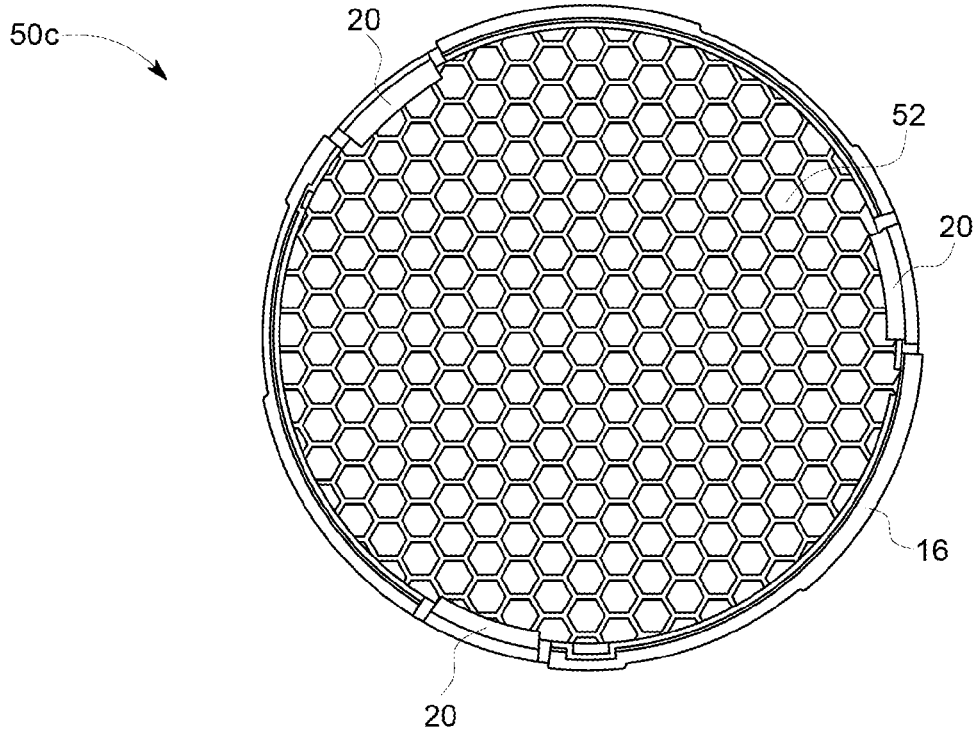
Figure 5D:
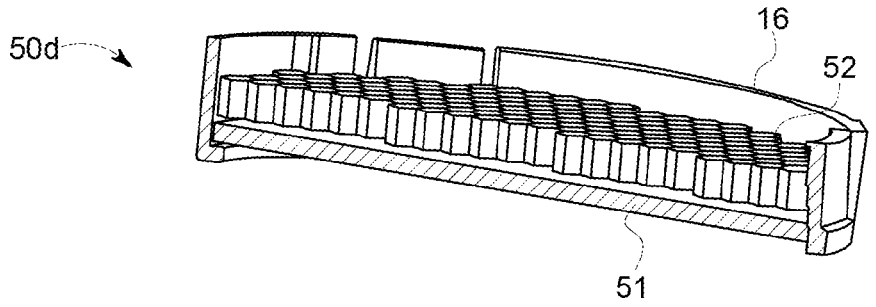

FIG. 5C is a top view 50*c* of the ring holder 16 assembled with the Hexcel Louver 52 on the top of the diffuser 51. It is clearly shown how the springs 20 hold the Hexcel Louver 52 and the diffuser 51 in place. Finally FIG. 5D is a cross sectional view 50*d* of the ring holder 16 assembled with the Hexcel Louver 52 on the top of the diffuser 51.

Figure 6:
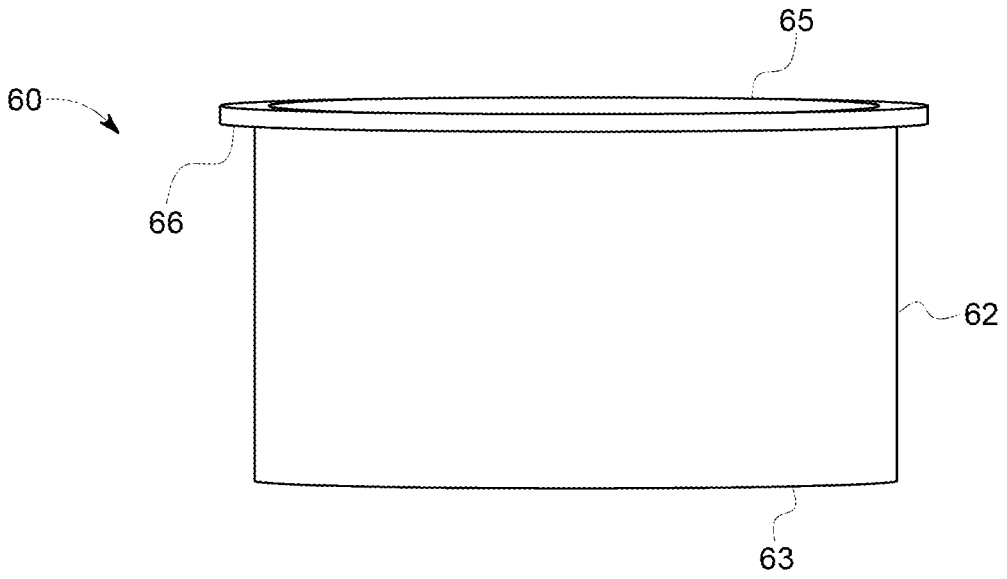
FIG. 6 is an exemplary view of a snoot (optical accessory) for reducing light glare, which can be used in a ring holder according to an embodiment of the invention.

FIG. 6 is exemplary view of a snoot (optical accessory) 60. The snoot 60 can be made of a metal or plastic material and can be used in the ring holder 16 for narrowing the light beam and reducing glare. The snoot 60 comprises a hollow cylinder 62 having ends 63 and 65, and further having a flange 66 at the end 65 of the cylinder 62. The external diameter of the flange 66 is matched to the internal diameter of the side wall 28 in FIG. 2, so that the snoot 60 can be inserted into the ring holder 16 through the top 23, and slid in until the flange 66 is placed on the ledges 22 and then secured by the springs 20.

It is noted that a bottom portion in the light fixture 10 shown in FIG. 1 would need to be removed to access the ring holder 16 comprising the snoot 60. The snoot 60 needs to be the first accessory inserted into the ring holder 16, so that additional optical accessories can be placed on the top of it if necessary.

Thus, the light accessory holder has many advantages associated with the novel and unique features which include (but are not limited to):

- one piece simplified design which can provide lower manufacturing cost,
- notched design holding accessories in place,
- customization of components can be done at the installation site and does not require ordering additional mechanical component,
- customers can change their existing light fixture by using different accessories without having to buy a new light fixture,
- light fixture can have multiple configurations without ordering additional mechanical components, and
- a universal looking fixture is provided even if accessories are changed for light quality purposes.

Unless defined otherwise, technical and scientific terms used herein have the same meaning as is commonly understood by one having ordinary skill in the art to which this disclosure belongs. The terms "first", "second", and the like, as used herein, do not denote any order, quantity, or importance, but rather are employed to distinguish one element from another. Also, the terms "a" and "an" do not denote a limitation of quantity, but rather denote the presence of at least one of the referenced items. The use of "including," "comprising" or "having" and variations thereof herein are meant to encompass the items listed thereafter and equivalents thereof, as well as additional items. The terms "connected" and "coupled" are not restricted to physical or mechanical connections or couplings, and can include electrical and optical connections or couplings, whether direct or indirect.

Furthermore, the skilled artisan will recognize the interchangeability of various features from different embodiments. The various features described, as well as other known equivalents for each feature, can be mixed and matched by one of ordinary skill in this art, to construct additional systems and techniques in accordance with principles of this disclosure.

In describing alternate embodiments of the apparatus claimed, specific terminology is employed for the sake of clarity. The invention, however, is not intended to be limited to the specific terminology so selected. Thus, it is to be understood that each specific element includes all technical equivalents that operate in a similar manner to accomplish similar functions.

It is to be understood that the foregoing description is intended to illustrate and not to limit the scope of the invention, which is defined by the scope of the appended claims. Other embodiments are within the scope of the following claims.

It is noted that various non-limiting embodiments described and claimed herein may be used separately, combined or selectively combined for specific applications.

Further, some of the various features of the above non-limiting embodiments may be used to advantage, without the corresponding use of other described features. The foregoing description should therefore be considered as merely illustrative of the principles, teachings and exemplary embodiments of this invention, and not in limitation thereof.

The invention claimed is:

1. A holder, in a lighting fixture for placing interchangeable optical accessories near a light source, comprising:

one part, having a closed perimeter structure with a side wall crossing a perimeter and perpendicular to a perimeter plane, the side wall being limited by bottom and top planes and having top and bottom openings, the one part is configured to accommodate placing one or more optical accessories inside the side wall, where each of the one or more optical accessories matches internal dimensions of the side wall for smooth inserting to and for forming a close fit with internal surfaces of the side wall, the one part further comprises:

multiple springs, spaced along the perimeter and vertically cut in the side wall from the top plane toward the bottom plane until a predefined distance from the bottom plane, where each spring originated near the bottom plane is tilted inward from the perimeter by a predefined extent, so that when each accessory of the one or more optical accessories is inserted into the one part through the top opening, at least one of the multiple springs is manually bent outward of the perimeter to allow the each accessory to slide down inside the side wall, and then, after the at least one spring being brought back to an original position by a spring effect, the multiple springs tightly hold the each optical accessory in place; and multiple ledges, spaced along the perimeter on the bottom plane and attached to the side wall, configured to keep optical accessories from falling down.

2. The holder of claim 1, wherein each of the multiple springs comprises notches, parallel to the bottom plane, along the perimeter, at different distances from the bottom plane in order to push forward and hold the each inserted accessory in a desired position.

3. The holder of claim 1, when placed in a lighting fixture, is held in place by a spring force generating by bended legs of the holder spaced along the perimeter and attached to a bottom surface of the side wall.

4. The holder of claim 3, wherein the bended legs are 120° apart.

5. The holder of claim 1, wherein the holder is removable from and interchangeable in the lighting fixture, without any additional lock feature, for loading different optical accessories.

6. The holder of claim 1, wherein the perimeter comprises a circle.

7. The holder of claim 1, wherein the holder and the inserted one or more optical accessories have a common optical axis parallel to the side wall.

8. The holder of claim 1, wherein the perimeter comprises a rectangle.

9. The holder of claim 1, wherein the perimeter comprises an ellipse.

10. The holder of claim 1, wherein an outside dimension of the one or more optical accessories and a corresponding inside dimension of the side wall are matched, where the outside dimension of the one or more optical accessories being smaller than the inside dimensions of the side wall by a predefined small value to provide said smooth inserting and for forming a close fit with the side wall.

11. The holder of claim 1, wherein the multiple springs comprise three strings 120° apart.

12. The holder of claim 1, wherein an inside surface of the side wall comprises at least two vertical grooves of different sizes for allowing only one direction of installation of corresponding optical accessories when inserted into the holder by matching with corresponding features complimenting the at least two vertical grooves on the corresponding optical accessories.

13. The holder of claim 1, wherein the bottom and top planes are parallel.

14. The holder of claim 1, wherein the holder is made of a plastic material using injection molding.

15. The holder of claim 1, wherein one of the one or more optical accessories comprises a diffuser.

16. The holder of claim 1, wherein one of the one or more optical accessories comprises an optical filter.

17. The holder of claim 1, wherein one of the one or more optical accessories comprises a Hexcel Louver.

18. The holder of claim 1, wherein one of the one or more optical accessories comprises a snoot.

19. The holder of claim 1, wherein the light source comprises one or more light emitting diodes (LEDs).

* * * * *